US011815303B2

(12) United States Patent
Zanqueta et al.

(10) Patent No.: US 11,815,303 B2
(45) Date of Patent: Nov. 14, 2023

(54) MULTI-SELECT SINGLE REFRIGERATING APPLIANCE DRAWER

(71) Applicant: Electrolux Home Products, Inc., Charlotte, NC (US)

(72) Inventors: Hugo Flavio Benassi Zanqueta, Anderson, SC (US); Kyung (Ken) Jang, Anderson, SC (US); Eduardo Alves Cardoso, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 291 days.

(21) Appl. No.: 17/142,296

(22) Filed: Jan. 6, 2021

(65) Prior Publication Data

US 2022/0214095 A1 Jul. 7, 2022

(51) Int. Cl.

| | |
|---|---|
| ***F25D 11/02*** | (2006.01) |
| ***F25D 17/06*** | (2006.01) |
| ***F25D 23/04*** | (2006.01) |
| ***F25D 23/06*** | (2006.01) |
| ***F25D 29/00*** | (2006.01) |

(52) U.S. Cl.

CPC ..... *F25D 17/065* (2013.01); *F25D 11/02* (2013.01); *F25D 23/04* (2013.01); *F25D 23/063* (2013.01); *F25D 23/069* (2013.01); *F25D 29/00* (2013.01); *F25D 2317/0661* (2013.01); *F25D 2400/14* (2013.01); *F25D 2700/122* (2013.01)

(58) Field of Classification Search

CPC ..... F25D 11/02; F25D 17/065; F25D 23/04; F25D 23/063; F25D 23/069; F25D 2317/061; F25D 2317/0661; F25D 2317/067; F25D 2317/0682; F25D 2400/14; F25D 25/025; F25D 2700/122; F25D 2700/123; F25D 29/00

See application file for complete search history.

(56) References Cited

U.S. PATENT DOCUMENTS

| | | | | |
|---|---|---|---|---|
| 5,884,491 | A * | 3/1999 | Kim | F24F 13/075 454/258 |
| 7,228,704 | B2 | 6/2007 | Rand et al. | |
| 7,296,433 | B2 | 11/2007 | Uihlein et al. | |
| 8,733,867 | B2 | 5/2014 | Hwang et al. | |
| 8,960,824 | B2 | 2/2015 | Wilcox et al. | |

(Continued)

FOREIGN PATENT DOCUMENTS

| | | |
|---|---|---|
| CN | 108387042 A | 8/2018 |
| CN | 108458536 A | 8/2018 |

(Continued)

OTHER PUBLICATIONS

International Search Report for PCT/US2021/063479 dated Apr. 4, 2022, 2 pages.

*Primary Examiner* — Filip Zec

(74) *Attorney, Agent, or Firm* — Pearne & Gordon LLP

(57) ABSTRACT

A refrigerator drawer having a body having a front panel, a rear panel, two side panels, more than one pivotable dividers, each divider pivotable between use and non-use positions, the dividers capable of dividing the drawer body into more than one compartments, a ducted cover and/or a ducted bottom, the ducted cover and ducted bottom each having a channel connecting to more than one fans, and a temperature sensor located within each of the possible compartments is provided.

19 Claims, 8 Drawing Sheets

(56) References Cited

U.S. PATENT DOCUMENTS

| | | | | |
|---|---|---|---|---|
| 9,207,011 | B2 * | 12/2015 | Song | F25D 23/069 |
| 9,759,479 | B2 | 9/2017 | Ramm et al. | |
| 9,816,746 | B1 * | 11/2017 | Haney | F25D 23/04 |
| 10,006,693 | B2 * | 6/2018 | Ramm | F25D 25/025 |
| 10,203,151 | B2 | 2/2019 | Cizik et al. | |
| 10,215,479 | B2 | 2/2019 | Rindlisbach et al. | |
| 10,240,856 | B2 | 3/2019 | Park et al. | |
| 10,240,860 | B2 | 3/2019 | Han et al. | |
| 10,436,500 | B2 * | 10/2019 | Jo | F25D 23/069 |
| 10,451,339 | B1 * | 10/2019 | Wantland | F25D 23/069 |
| 10,677,522 | B1 | 6/2020 | Stauffer et al. | |
| 10,743,662 | B2 * | 8/2020 | Li | F25D 25/025 |
| 2008/0282714 | A1 | 11/2008 | Cushman | |
| 2008/0302125 | A1 * | 12/2008 | Cushman | F25D 17/065 62/408 |
| 2011/0259036 | A1 * | 10/2011 | Lim | F25D 25/025 62/340 |

FOREIGN PATENT DOCUMENTS

| | | | | |
|---|---|---|---|---|
| CN | 109539663 | A | 3/2019 | |
| CN | 111047791 | A | 4/2020 | |
| DE | 10242518 | | 5/2006 | |
| EP | 2551618 | | 1/2013 | |
| EP | 2150759 | | 10/2017 | |
| EP | 2713124 | B1 | 1/2019 | |
| KR | 20140124115 | A | 10/2014 | |
| WO | WO2009099441 | | 8/2009 | |
| WO | WO-2019154377 | A1 * | 8/2019 | F25D 11/02 |

* cited by examiner

MULTI-SELECT SINGLE REFRIGERATING APPLIANCE DRAWER

FIELD OF INVENTION

The instant invention relates multi-select single refrigerating appliance drawer separable into up to more than one compartments wherein the temperature of each compartment may be independently controlled by way of user interface.

BACKGROUND OF THE INVENTION

Conventional refrigerating appliances, such as domestic refrigerators, typically have both a fresh food compartment and a freezer compartment or section. The fresh food compartment is where food items such as fruits, vegetables, and beverages are stored. The freezer compartment is where food items that are to be kept in a frozen condition are stored. The refrigerating appliances are provided with refrigeration systems that maintains the fresh food compartment at temperatures above 0° C., such as between 0.25° C. and 4.5° C. and the freezer compartments at temperatures below 0° C., such as between 0° C. and −20° C.

The arrangements of the fresh food and freezer compartments with respect to one another vary. For example, in some cases, the freezer compartment is located above the fresh food compartment and in other cases the freezer compartment is located below the fresh food compartment. Additionally, many modern refrigerating appliances have their freezer compartments and fresh food compartments arranged in a side-by-side relationship.

Refrigerating appliance, such as refrigerators, may include drawers for storage of meats, fruits, vegetable, dairy products and the like, particularly in, but not limited to, the fresh food compartment. Generally, the conditions, such as temperature and humidity, of such drawers are controlled by setting the size of an opening between the drawer and the main chamber of the refrigerating appliance or between the drawer and a cold air supply duct. In such instances, the exchange of air into and out of the drawer occurs by air flow or static exchange. Such cooling of a drawer may not always provide optimum temperatures for the contents of the drawing. For example, when a drawer is opened or closed, the temperature of the drawer may change and may require a significant amount of time to reach optimum temperature again. Moreover, such drawers are generally confined to a single temperature over the entire drawer and therefore, each drawer is limited to a single special use, e.g. for fruits, dependent upon the opening setting.

Users of a refrigerating appliance, however, may not have a sufficient quantity of each particular type of food to fill an entire drawer. Additionally, drawers for each type of food and/or intended use may not be supplied in a refrigerating appliance, and if supplied, may occupy an excessive amount of space in the appliance. Consequently, there is a need for a refrigerating appliance drawer which can be subdivided into separate compartments and wherein each separate compartment may be actively temperature controlled and monitored so as to maintain optimum conditions for the intended contents and/or use.

SUMMARY OF THE INVENTION

The instant invention is a multi-select single refrigerating appliance drawer which can be divided into multiple compartments, each compartment temperature controlled for an intended content and/or use set by a user.

In a first embodiment, the invention provides refrigerating appliance drawer comprising a body having a front panel, a rear panel, two side panels, and a floor panel, and wherein the body is divisible into more than one compartments, and wherein a temperature sensor is located within each of the more than one possible compartments; pivotable dividers, each divider pivotable between a non-use position in which the divider lies on the floor panel of the body and a use position in which it is upright and perpendicular to the floor panel of the body; a ducted cover sized and configured to fit over the body having a channel on an upper surface of the cover, the channel connecting to each of more than one fans, one fan located over each of the more than one possible compartments, wherein the channel further connects to a cold air supply duct or an air return duct; and a control system connected to each of the fans and each of the temperature sensors and a user interface.

In another embodiment, the invention provides refrigerating appliance drawer comprising a body having a front panel, a rear panel, two side panels, and a roof panel, and wherein the body is divisible into more than one compartments, and wherein a temperature sensor is located within each of the more than one possible compartments; a ducted floor sized and configured to fit under the body, the ducted floor having a bottom channel on a lower surface of the ducted bottom, the channel connecting to each of more than one bottom fans, one bottom fan located under each of the more than one compartments, and wherein the bottom channel further connects to a cold air supply duct or an air return duct; pivotable dividers, each divider pivotable between a non-use position in which the divider lies on a ducted bottom and a use position in which the divider is upright and perpendicular to the ducted bottom; and a control system connected to each of the fans and each of the temperature sensors and a user interface.

In an alternative embodiment, the invention is a refrigerating appliance drawer according to any of the foregoing embodiments further comprising a hub located at a centerpoint of the floor panel, the hub configured to support and/or stop each of the dividers when a divider is in a use position.

In another embodiment, the invention is a refrigerating appliance drawer according to any of the foregoing embodiments further comprising a solid panel configured to fit over the ducted cover or under the ducted bottom.

In yet another embodiment, the invention is a refrigerating appliance according to any of the foregoing embodiments, wherein the user interface permits a user to select a temperature setting for each of the more than one compartments.

In yet another embodiment, the invention is a refrigerating appliance according to any of the foregoing embodiments, wherein the user interface permits a user to select an intended content for each of the more than one compartments.

In yet another embodiment, the invention is a refrigerating appliance according to any of the foregoing embodiments, wherein the fans are variable speed fans.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities and scale shown.

DETAILED DESCRIPTION OF EMBODIMENTS OF THE INVENTION

Figure 1:
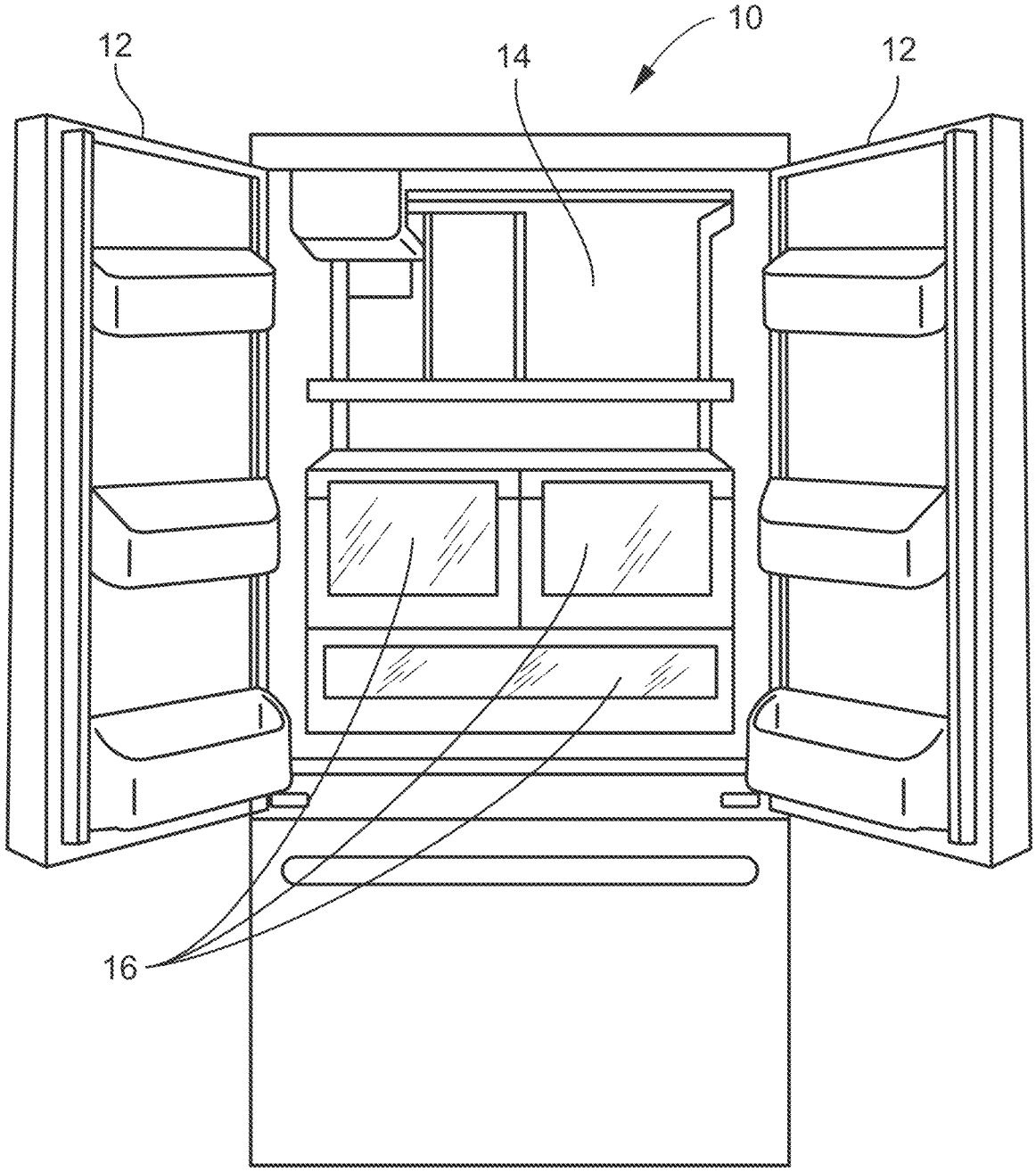
FIG. 1 is a front perspective view of a household French door bottom mount refrigeration appliance showing doors of the fresh food compartment in opened positions and showing drawers located therein.

Embodiments of a refrigerating appliance or a component thereof now will be described with reference to the accompanying drawings. Whenever possible, the same reference numerals are used throughout the drawings to refer to the same or like parts.

Referring to FIG. 1, a French door bottom mount refrigerator indicated generally at 10 with the French doors 12 open to reveal the interior of a fresh food compartment 14. The refrigerator of FIG. 1 includes two French doors 12 enclosing a fresh food compartment 14 and a slide out freezer compartment enclosed by a freezer door 16. As can be seen in FIG. 1, the fresh food compartment 14 may include one or more drawers 16*a*, 16*b*, 16*c* for holding particular types of foods. Such fresh food drawers 16 are usually configured to hold meats, fruits, vegetable or dairy products, such as yogurt, cheeses, and butter.

The refrigerator or refrigerating appliance 10 useful in various embodiments of the invention can have any desired configuration including at least a fresh food compartment 14. In some embodiments, the refrigerator 10 may also include a freezer compartment, such as a top mount refrigerator (freezer disposed above the fresh food compartment), a side-by-side refrigerator (fresh food compartment is laterally next to the freezer compartment), a standalone refrigerator or freezer, etc.

Figure 2:
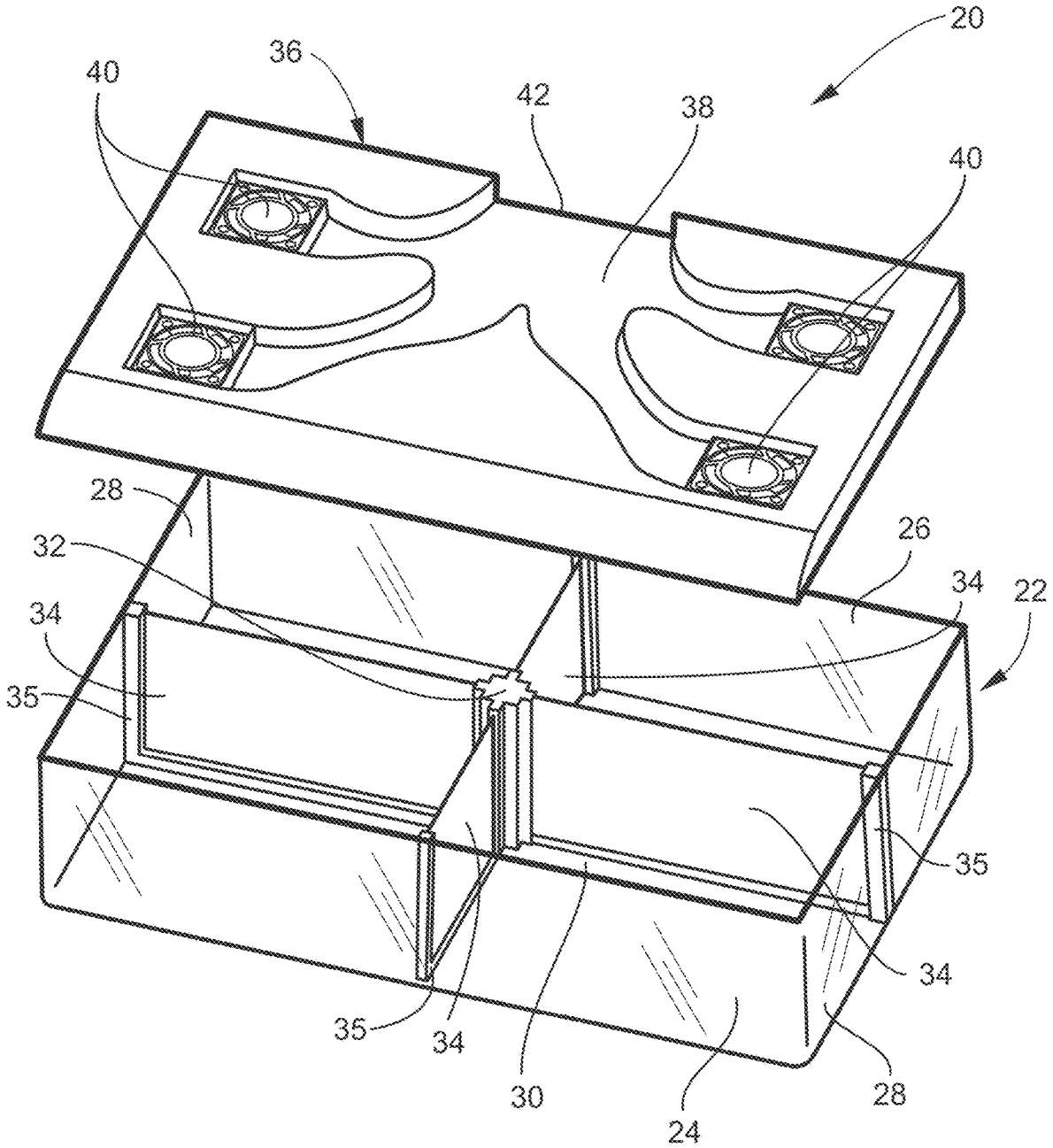
FIG. 2 is a perspective, partially exploded view of a first embodiment of a drawer of the present invention with all of the dividers in use position.

Referring to FIG. 2, a first embodiment of the inventive drawer 20 is shown. The drawer 20 includes a body 22 which is made up of a front panel 24, a rear panel 26, two side panels 28, and a floor panel 30. A hub 32 extends upward from a centerpoint of the floor panel 30. In the embodiment illustrated in FIG. 2, the drawer 20 includes four dividers 34 which are pivotably mounted to a bottom portion of the hub 32. In alternative embodiments, the drawer 20 may include fewer or more dividers 34, dividing the drawer 20 into two or more compartments, depending on the number of dividers placed in a use, or upright, position.

As shown in the embodiment of FIG. 2, one divider extends between hub 32 and the front panel 24. Another divider 34 extends between hub 32 and rear panel 26. A third divider 34 extends between hub 32 and a first side panel 28 and a fourth divider 34 extends between hub 32 and a second side panel 28.

Figure 3:
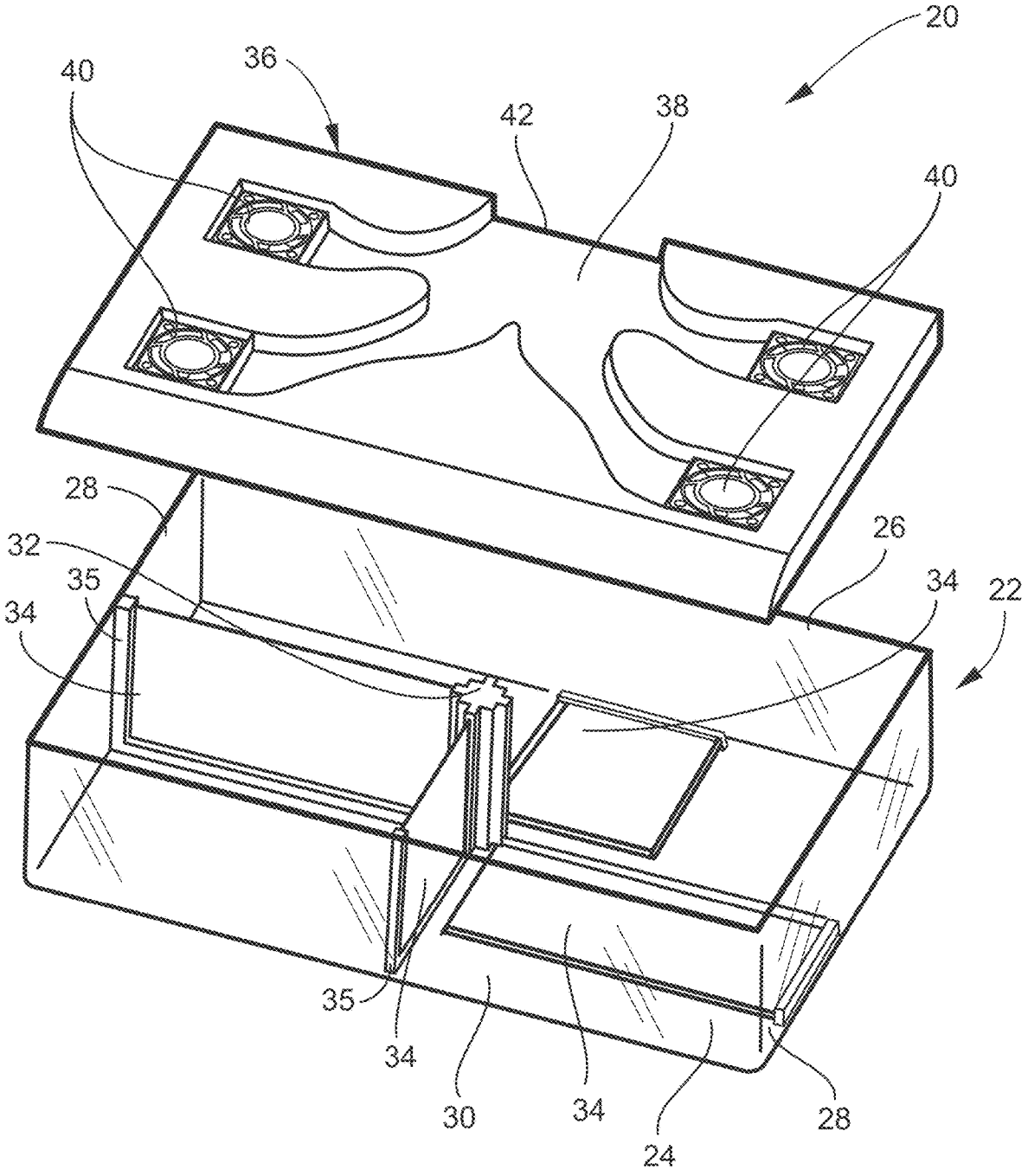
FIG. 3 is a perspective, partially exploded view of the embodiment shown in FIG. 2 with two of the dividers in use position.

In FIG. 2, all of the dividers are shown in a use position, thereby dividing body 22 into four substantially equally sized compartments 23. However, in alternative embodiments, the dividers 34 may be positioned as to divide the body 22 into differently sized compartments. In FIG. 3, two of the dividers 34 are in use position and two of the dividers 34 are in non-use position. In a non-use position, a divider 34 lays substantially flat on the floor panel 30. The dividers 34 may pivot upward to a use, or upright, position. The dividers 34 may be held in use position with any means, such as magnetic strips, or clips (not shown). The dividers 34 are sized and configured such that when in the use position, the dividers 34 reach from the floor panel 30 to a lower surface of a ducted cover 36 enclosing the drawer body 22. In FIGS. 2 and 3, the ducted cover 36 is show in partially exploded view. It will be understood that the ducted cover 36 is positioned to serve as a roof of the body 22 and sits atop and may be, in some embodiments, connected to a top edge of the body 22. As shown in the embodiment in FIGS. 2 and 3, when all four dividers 34 are placed in the use position, the body 22 is divided into four compartments 23. Likewise, when three of the dividers 34 are in the use position the drawer body 22 is divided into three compartments 23 and when two of the dividers 34 are in use position, the drawer is divided into two compartments 23 (as is shown in FIG. 3). The dividers 34 in some embodiments may include seals or gaskets along top, bottom and/or side edges in order to prevent air leakage between compartments of the body 22.

The ducted cover 36 includes a channel 38 providing a fluid connection between an air supply duct (not shown) or an air return duct (not shown). In the embodiment shown in FIG. 3, the ducted cover channel 38 connects to four fans 40 which are located so as to be in fluid connection with each of the four possible compartments of the body 22. As previously mentioned, body 22 may include fewer or more dividers than shown in the Figures. The number of fans and channel divisions may vary depending upon the number of dividers and the maximum number of possible compartments into which the body 22 may be divided. Each of the fans 40 are in electrical communication with a user interface and/or a refrigerator controller. Also located within the body 22 are temperature sensors (no shown), one temperature sensor located within each of the compartments 23 into which the body 22 can be divided. It will be readily understood that when the drawer body 22 is divided into less than the maximum number of compartments, at least one of the compartments will include more than one temperature sensor. Any temperature sensor capable of measuring temperatures within the typical range for refrigerating appliances may be used. Fans 40 place the drawer body 22 in fluid communication with the channel 38.

Figure 4:
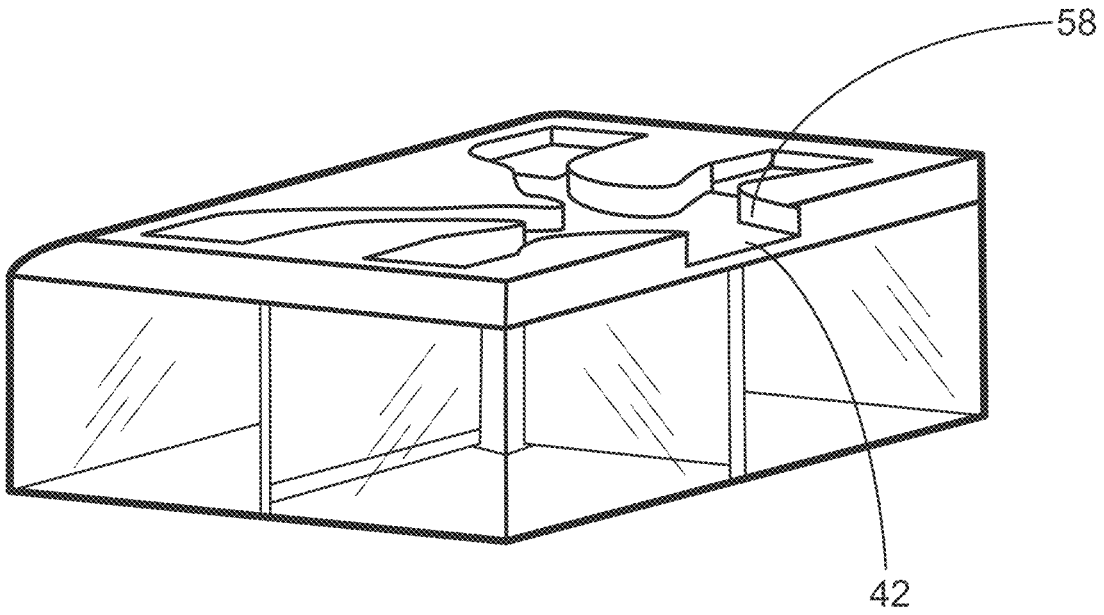
FIG. 4 is a rear perspective view of the first embodiment of a drawer.

FIG. 4 is a perspective view showing the rear side of the drawer 20 shown in FIGS. 2 and 3, in assembled condition. A channel end opening 42 of channel 38 is shown. Opening 42 connects to either an air supply duct or an air return duct. In the embodiment shown in FIG. 4, channel end opening 42 would generally connect to an air supply duct so that cold air may be drawn into the body 22 and any compartments 23 formed therein by the dividers 34. FIG. 4 also illustrates a top surface of the ducted cover 36 being capped with a top cover 58.

Figure 5:
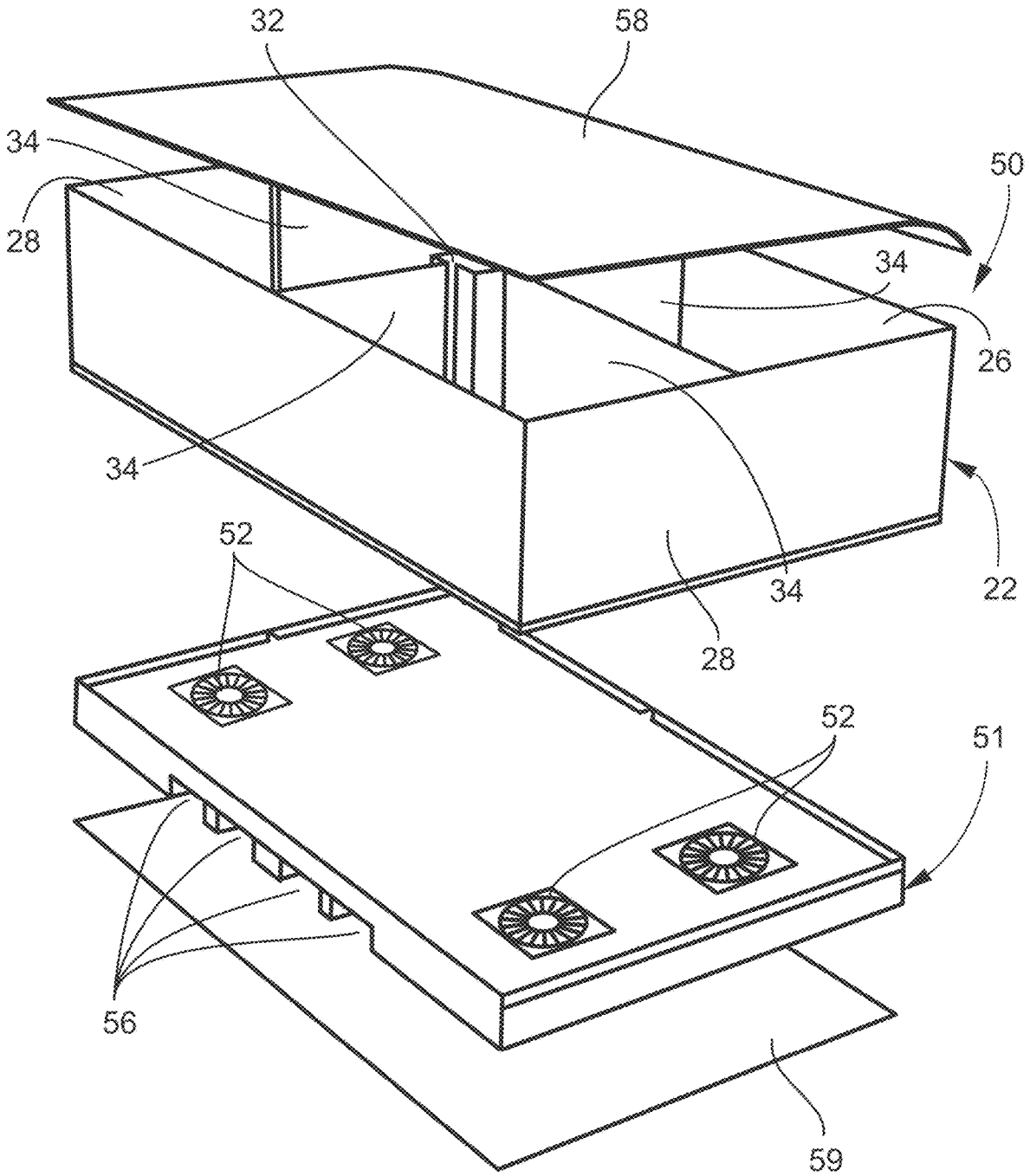
FIG. 5 is a perspective, partially exploded view of a second embodiment of a drawer of the present invention with all of the dividers in use position.

Referring now to FIG. 5, a second embodiment of the inventive drawer 50 is shown in which a ducted floor 51 is illustrated. Ducted floor 50 includes four bottom fans 52 which are in fluid communication with the body 22 and a bottom channel 54 positioned on a lower surface of the ducted floor 51. Ducted floor 51 includes one or more bottom channel end openings 56 which are configured to communicate with and/or connect with an air supply duct and/or an air return duct. The second embodiment further includes dividers 34, hub 32, temperature sensors and drawer body 22 as discussed in connection with FIGS. 2 and 3. As shown in FIG. 5, the second embodiment may include a simple top cover 58 in lieu of a ducted cover 36. In some embodiments, a bottom surface of the ducted floor 51 and the bottom channel 54 may be covered and enclosed with a bottom cover 59.

Figure 6:
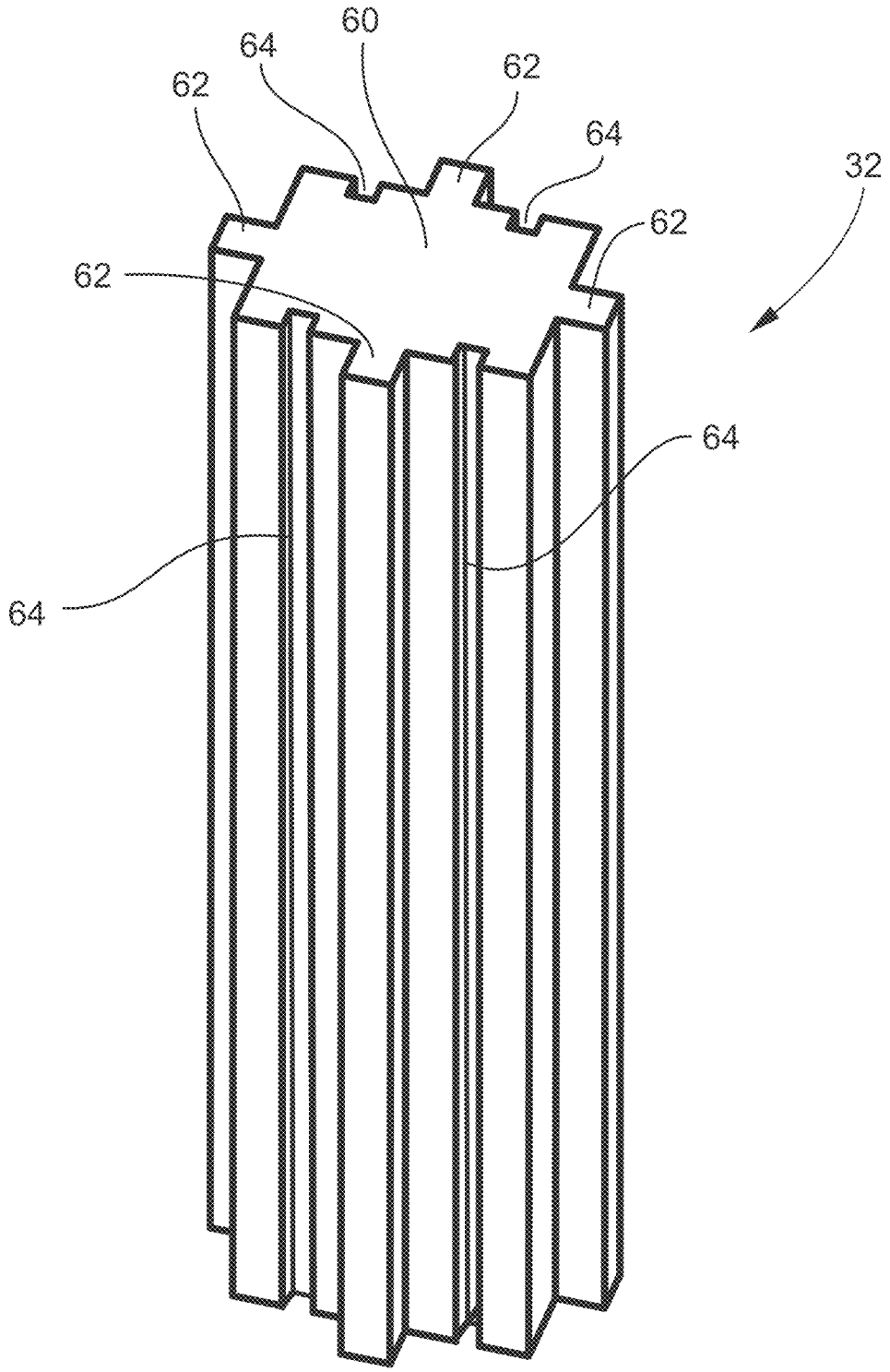
FIG. 6 is a perspective view of one embodiments of a hub.

FIG. 6 illustrates one embodiment of a hub 32, the hub 32 configured to accommodate up to four dividers 34. In such embodiment, hub 32 includes a center support 60 having a generally square or rectangular cross section. The center support 60 further includes four flanges 62 extending outwardly from each face of center support 60. At least one face of the center support 60 in each possible compartment further includes, in some embodiments, an indentation 64 running along the height of the center support 60. The indentations 64 provide additional means for fluid communication between the body 22 or compartments 23 and either or both of channel 38 of ducted cover 36 and bottom channel 54 of ducted floor 51. Hub 32 further includes means (not shown) for pivotably mounting dividers 34 at a bottom end of hub 32. Such means may include, for example, a depression (not shown) on each face of the center support 60, the depression configured to accept a pin (not shown) protruding from a bottom inner side edge a divider 34. In alternative embodiments, the hub 32 could have any closed cross sectional shape, such as circular, rectangular, or octagonal. In one embodiment, the hub is integrally molded with a floor panel 30 of the body 22. In an alternative embodiment, the hub and dividers may form a removable unit which can be removably placed inside the body 22. In yet another embodiment, the hub 32 may be integrally formed with a top cover 58, a ducted floor 51, and/or a ducted cover 36. In yet another alternative embodiment, the hub 32 is removably attached to a floor panel 30, a top cover 58, a ducted floor 51, and/or a ducted cover 36, such as by bolt, screw, fastener or adhesive.

Figure 7:
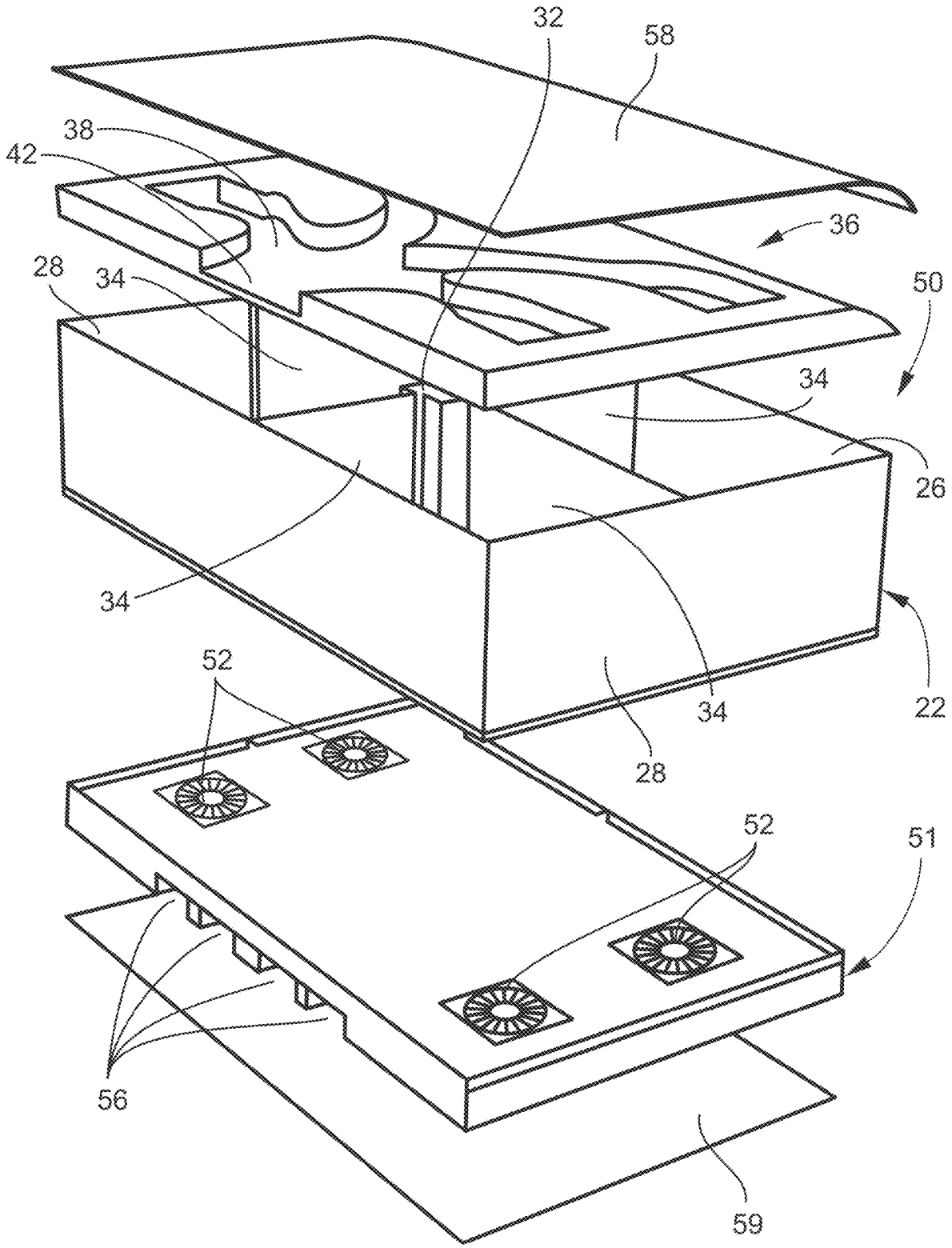
FIG. 7 is an exploded perspective view of a third embodiment of a drawer of the present invention.

FIG. 7 illustrates, in exploded perspective view, a third embodiment of the inventive drawer 70 including both a ducted floor 51 and a ducted cover 36. Drawer 70 further includes a top cover 58, body 22, dividers 34, hub 32, and bottom cover 59. In such embodiment a floor panel 30 is optional. If present, the floor panel 30 includes a grill (not shown) to permit fluid communication between the bottom channel and the body 22 by way of bottom fans 52.

In view of the first, second and third embodiments illustrated herein, it will be readily understood that any combination of a ducted cover and ducted bottom are within the scope of the invention. Moreover, it should be understood that while the embodiments are illustrated with four dividers 34, the drawer 20, 50, or 70 could alternatively be provided with two, three, or more dividers 34.

Figure 8:
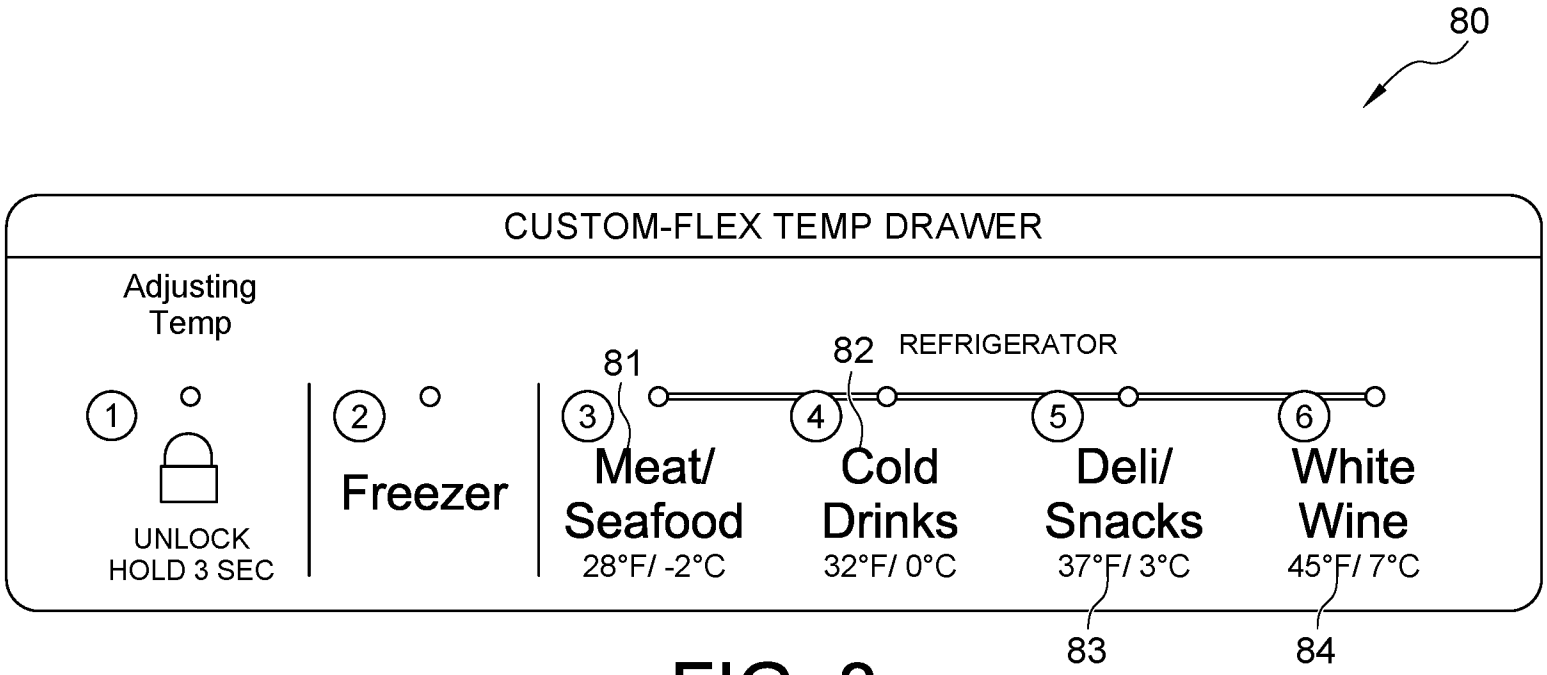
FIG. 8 is a front perspective view of an exemplary user interface.

An exemplary but non-limiting user interface 80 is shown in FIG. 8. The user interface 80 may connect directly or indirectly with fans 40 and/or bottom fans 52, the temperature sensors in each compartment, and/or a refrigerating appliance controller. As used herein, refrigerating appliance controller may include any controller used in a refrigerating appliance, such as a main refrigerator controller, a main freezer controller or a subcomponent thereof, such as a drawer controller. As shown in FIG. 8, the user interface 80 may allow a user to select a temperature, temperature range, and/or end use for the drawer 20, 50, or 72 as a whole or for each compartment 23. For example, buttons 81-84 may be used when a drawer is divided into four compartments, allowing the user to select one of four different options for temperature range or intended use for each compartment. Such temperature ranges/end uses may include, for example, meat and seafood, cold drinks, deli goods and snacks, and wine. Alternative options could include, for example, alcoholic beverages, fruits, vegetables, and dairy products. As shown in FIG. 8, rather than selecting an end use, a user may be permitted to select a temperature, including for example, 28° F./−2° C., 32° F./0° C., 37° F./3° C., or 45° F./7° C. In alternative embodiment, an end user may be given an option to choose a temperature range rather than a set temperature. The user interface may be located on a front panel of the drawer or on a refrigerating appliance control center located remotely from the drawer.

The invention further provides any of the foregoing embodiments, further including a drawer 20, 50, or 72 positioned in a freezer compartment. In such uses, the end uses which may be selected by a user may include, for example, quick freeze, frozen dairy, uncooked meats, frozen vegetable, and frozen prepared foods. Likewise, the user interface for a divisible and temperature controlled drawer in the freezer compartment may be permitted to select a set temperature or temperature range.

As illustrated in the appended figures, the drawers 20, 50, and 72 are illustrated as having a rectangular shape with a certain relative depth. However, it should be understood that the invention relates to a divisible drawer with temperature control by use of temperature sensors and fans. The inventive drawer may have any configuration and relative depth. For example, inventive drawer may be rectangular and shallow, rectangular and deep, square and shallow or square and deep.

The temperature within the inventive drawer as a whole or within the compartments thereof may be controlled by forcing air from an air supply duct into the drawer or compartments with passive outflow of air from the drawer or compartments. In an alternative embodiment, air may be sucked out of the drawer or compartments with passive inflow of cold air into the drawer or compartments. In yet another alternative embodiment, the temperature of the drawer or compartments may be regulated by forced air, by use of fans, from an air supply duct into the drawer or compartments in conjunction with forced air venting, by use of fans, from the drawer or compartments into an air return duct and/or into the fresh food compartment.

In some embodiments, all fans are operated while in other embodiments, each fan is independently operable. The fans may be single speed fans or alternatively, variable speed fans. The fans may be all of a single type or different types of fans.

While the appended figures illustrate certain components as transparent and other components as opaque, it will be understood that any of the elements may be opaque, translucent, transparent, or any combination thereof.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims and their equivalents.

What is claimed is:

1. A drawer comprising:

a body having a front panel, a rear panel, two side panels, and a floor panel;

a hub centrally located in the body;

a plurality of pivotable dividers connected to the hub, each pivotable divider pivotable between a flat non-use position and an upright use position, wherein when at least two of the pivotable dividers are in the upright use position, the body is divided into a plurality of compartments;

more than one temperature sensors, one sensor located within each of the plurality of compartments; and a ducted cover sized and configured to fit over the body, the ducted cover having a channel on an upper surface of the ducted cover, the channel connecting to more than one fans, one fan located over each of the plurality of compartments, wherein the channel is configured to be in fluid communication with a cold air supply duct or an air return duct, wherein the hub extends between a lower surface of the ducted cover and an upper surface of the floor panel, and wherein each of the plurality of pivotable dividers extends between the lower surface of the ducted cover and the upper surface of the floor panel, and wherein a gasket is provided along an edge of each of the plurality of pivotable dividers to prevent air leakage between said plurality of compartments of the body.

2. The drawer of claim 1, further comprising a top cover configured to fit over the ducted cover.

3. The drawer of claim 1, wherein the temperature sensors and the fans are in operable connection with a user interface.

4. The drawer of claim 3, wherein the user interface permits a user to select an intended use and/or temperature for each of the plurality of compartments.

5. The drawer of claim 1, wherein the fans are variable speed fans.

6. The drawer of claim 1, wherein the floor panel further comprises more than one openings wherein one opening is located within each of the plurality of compartments; and a ducted bottom sized and configured to fit under the floor panel having a bottom channel on a lower surface of the ducted bottom, the bottom channel connecting to each of more than one bottom fans, each bottom fan located to be in fluid communication with one of the more than one openings in the floor panel, and wherein the bottom channel further is configured to be fluid communication with a cold air supply duct or an air return duct.

7. The drawer of claim 6, further comprising a bottom cover.

8. A refrigerator comprising the drawer of claim 1.

9. The refrigerator of claim 8, wherein the refrigerator having a fresh food compartment has a French door bottom mount configuration.

10. A drawer comprising:

a body having a front panel, a rear panel, two side panels, and a roof panel;

a hub centrally located in the body, more than one pivotable dividers connected to the hub, each pivotable divider pivotable between a non-use position and a use position, wherein when all pivotable dividers are in the use position, the body is divided into more than one compartments;

more than one temperature sensors, one sensor located within each of the more than one compartments; and a ducted floor sized and configured to fit under the body, the ducted floor having a bottom channel on a lower surface of the ducted floor, the bottom channel connecting to more than one bottom fans, one bottom fan located under each of the more than one compartments, wherein the bottom channel is configured to be in fluid communication with a cold air supply duct or an air return duct.

11. The drawer of claim 10, wherein the hub extends between a lower surface of the roof panel and an upper surface of the ducted floor.

12. The drawer of claim 10, further comprising a bottom cover configured to fit under the ducted floor.

13. The drawer of claim 10, wherein the temperature sensors and bottom fans are in operable connection with a user interface.

14. The drawer of claim 13, wherein the user interface permits a user to select an intended use for each of the more than one compartments.

15. The drawer of claim 10, wherein the bottom fans are variable speed fans.

16. The drawer of claim 10, wherein the roof panel further comprises more than one openings wherein one opening is located within each of the more than one compartments; and a ducted cover sized and configured to fit over the body, the ducted cover having a channel on an upper surface of the ducted cover, the channel connecting to more than one fans, each fan located to be in fluid communication with one of the more than one openings in the roof panel, and wherein the channel is configured to be in fluid communication with a cold air supply duct or an air return duct.

17. A refrigerator comprising the drawer of claim 10.

18. The refrigerator of claim 17, wherein the refrigerator has a French door bottom mount configuration.

19. A drawer comprising:

a body having a front panel, a rear panel, two side panels, a ducted cover and a ducted floor;

a hub centrally located in the body, more than one pivotable dividers connected to the hub, each pivotable divider pivotable between a non-use position and a use position, wherein when all pivotable dividers are in the use position, the body is divided into between more than one compartments;

more than one temperature sensors, one sensor located within each of the more than one compartments;

wherein the ducted cover is sized and configured to fit over the body, the ducted cover having a top channel on an upper surface of the ducted cover, the top channel connecting to more than one top fans, one top fan located over each of the more than one compartments, wherein the top channel is configured to be in fluid communication with a cold air supply duct or an air return duct;

wherein the ducted floor sized and configured to fit under the body, the ducted floor having a bottom channel on a lower surface of the ducted floor, the bottom channel connecting to more than one bottom fans, one bottom fan located under each of the more than one compartments, wherein the bottom channel is configured to be in fluid communication with a cold air supply duct or an air return duct;

a top cover over a top surface of the ducted cover; and a bottom cover under a bottom surface of the ducted floor.

* * * * *